US010255893B1

(12) United States Patent
Clark

(10) Patent No.: US 10,255,893 B1
(45) Date of Patent: Apr. 9, 2019

(54) LOCKING STRING RETAINER FOR STRINGED MUSICAL INSTRUMENT

(71) Applicant: Murray R. Clark, North Little Rock, AR (US)

(72) Inventor: Murray R. Clark, North Little Rock, AR (US)

( * ) Notice: Subject to any disclaimer, the term of this patent is extended or adjusted under 35 U.S.C. 154(b) by 0 days.

(21) Appl. No.: 15/887,538

(22) Filed: Feb. 2, 2018

(51) Int. Cl.
*G10D 3/12* (2006.01)
*G10D 3/14* (2006.01)

(52) U.S. Cl.
CPC ..... *G10D 3/12* (2013.01); *G10D 3/146* (2013.01)

(58) Field of Classification Search
CPC ..... G10D 3/12; G10D 3/146
See application file for complete search history.

(56) References Cited

U.S. PATENT DOCUMENTS

| | | | | |
|---|---|---|---|---|
| 4,248,127 | A | 2/1981 | Lieber | |
| 4,475,432 | A | 10/1984 | Stroh | |
| 4,517,874 | A | 5/1985 | Fender | |
| 4,574,678 | A | 3/1986 | Edwards | |
| 4,579,033 | A | 4/1986 | Edwards | |
| RE32,863 | E | 2/1989 | Edwards | |
| 5,456,151 | A | 10/1995 | Enserink | |
| 5,932,822 | A * | 8/1999 | Bernstein | G10D 3/12 84/314 N |
| 6,130,373 | A | 10/2000 | Hall | |
| 7,378,582 | B2 | 5/2008 | Kinoshita | |
| 7,750,217 | B2 | 7/2010 | Decker | |
| 8,354,578 | B2 | 1/2013 | Decker | |
| 9,208,757 | B2 | 12/2015 | Artino | |
| 9,542,915 | B2 * | 1/2017 | Hackett | G10D 1/08 |
| 9,959,845 | B2 * | 5/2018 | Decker | G10D 3/00 |
| 2016/0307547 | A1 | 10/2016 | Artino | |
| 2017/0098436 | A1 * | 4/2017 | Hackett | G10D 1/08 |

FOREIGN PATENT DOCUMENTS

| | | |
|---|---|---|
| WO | 2016057178 | 4/2016 |

OTHER PUBLICATIONS

Bill Edwards Innovations, www.billedwards.com, Earliest date of publication Feb. 10, 2013, Accessed Jul. 5, 2018.
Vintage Kramer, http://www.vintagekramer.com/parts3.htm, Earliest date of publication Jun. 5, 2003, Accessed Jul. 5, 2018.

* cited by examiner

*Primary Examiner* — Robert W Horn
(74) *Attorney, Agent, or Firm* — Luedeka Neely Group, P.C.

(57) ABSTRACT

A locking string retainer minimizes undesired movement of instrument strings across the nut of a stringed instrument. When attached to the instrument headstock just behind the nut, the string retainer sets the angle at which the strings contact the nut. The string retainer includes a locking mechanism that is operated by a lever. When the lever is in the unlocked position, the instrument can be tuned and played normally. When the lever is in the locked position, the mechanism allows near zero travel of the strings across the nut, even during aggressive use of a vibrato bar. When the instrument inevitably does go out of tune, the user can easily unlock the string retainer, retune the instrument, and re-lock the retainer.

16 Claims, 3 Drawing Sheets

LOCKING STRING RETAINER FOR STRINGED MUSICAL INSTRUMENT

FIELD

This invention relates to the field of stringed musical instrument technology. Particularly, this invention relates to a string retainer for a stringed instrument that has the capability to easily clamp the strings or unclamp them at the user's choice.

BACKGROUND

In a stringed instrument such as a guitar, a string retainer sets the break angle of the strings over the nut or zero fret. This alleviates the need to angle the headstock backward in order to achieve a desired break angle. It may take the form of a bar under which all strings pass, or individual "string trees" as found on Fender™ designs.

Many guitar designs have included a vibrato system, which allows the user to shift the pitch of the strings through a movable bridge attached to an actuator bar. Examples of this include the Kauffman Vibrola (1929), the Bigsby Virato (1952), and the Fender Stratocaster "Floating Tremolo" (1954). Vibrato bridges are quite popular today.

A problem with these systems is the tendency of the use of the vibrato bar to throw the instrument out of tune. This occurs because the change in string length that creates the pitch shift also causes the string to travel across the nut or zero fret, and friction effects prevent it from returning to its original position upon release of the vibrato bar.

There are two approaches to solving this problem: (1) reducing the string friction at the nut to near zero, and (2) reducing the motion of the string across the nut to near zero. The search for solutions led to the development of the "double locking tremolo" (zero travel) such as the Floyd Rose system, and "roller nut" (zero friction) such as the Fender/LSR system. The main problem with locking nut systems is that the clamping action of the nut moves the string vertically and thus knocks the instrument out of tune, so that a special bridge with fine-tuning adjusters on the bridge is required. A side-locking nut design was introduced by Super Vee in 2007. This system has the advantage of eliminating vertical motion of the string upon locking the nut. This system has not been widely adopted, and the roller nut has had limited popularity. The double locking tremolo, however, has achieved very widespread use. This is in spite of the fact that there are serious convenience of use problems with them. If the actuation of the locking mechanism disturbs the pitch of the strings, a locking nut cannot be employed on a guitar with a standard bridge. Also, retuning is cumbersome: the nut must be unlocked (often requiring the use of tools), and the fine tuners centered. The instrument is tuned using the tuning keys as normal, the nut is relocked, and the instrument is retuned using the fine tuners.

What is needed is a device that achieves easy clamping and unclamping of the strings near the nut with near zero displacement, vertical or horizontal, that can be fitted to a guitar with a standard tremolo bridge.

SUMMARY

The above and other needs are met by a string retainer that secures musical instrument strings in relation to an instrument headstock of a stringed musical instrument. In one embodiment, the string retainer comprises a retainer block and a clamping actuator. The retainer block is configured to be secured to the instrument headstock between a nut and a tuner of the instrument. The retainer block includes an engagement surface, string apertures, an upper clamp bar, and a lower clamp bar. The engagement surface engages the instrument headstock when the retainer block is secured to the instrument. The string apertures, which are spaced apart from the engagement surface, receive the instrument strings. The upper clamp bar, which is disposed adjacent the string apertures and spaced apart from the engagement surface, has a lower surface against which the instrument strings make contact. The lower clamp bar, which is disposed adjacent the string apertures and between the upper clamp bar and the engagement surface, has an upper surface that is operable to move between first and second positions. In the first position, the upper surface makes contact with the instrument strings. In the second position, the upper surface is spaced apart from the instrument strings. The clamping actuator engages the lower clamp bar to cause the upper surface of the lower clamp bar to selectively move between the first and second positions. When the upper surface of the lower clamp bar is in the first position, the upper surface presses the strings firmly against the lower surface of the upper clamp bar, thereby substantially immobilizing the strings in relation to the upper clamp bar. When the upper surface of the lower clamp bar is in the second position, the strings are free to move in relation to the lower surface of the upper clamp bar.

In some embodiments, the clamping actuator comprises an actuator aperture disposed in the retainer block between the lower clamp bar and the engagement surface, with a cam rod rotatably disposed within the actuator aperture, and a lever affixed to an end of the cam rod. A force applied to the lever causes the cam rod to rotate within the actuator aperture into a first rotational position in which the cam rod engages the lower clamp bar to urge the upper surface of the lower clamp bar to move into the first position. Also, a force applied to the lever causes the cam rod to rotate within the actuator aperture into a second rotational position in which the cam rod is disengaged from the lower clamp bar to allow the upper surface of the lower clamp bar to move into the second position.

In some embodiments, the cam rod and the lever are integrally formed from one piece of metal.

In some embodiments, the upper clamp bar, lower clamp bar, string apertures, and engagement surface are integrally formed from one piece of material, such as plastic.

In some embodiments, the upper clamp bar is formed from metal, and the lower clamp bar, string apertures, and engagement surface are integrally formed from one piece of plastic.

In some embodiments, the retainer block includes flexure portions disposed to either side of the lower clamp bar to provide sufficient flexibility to allow the lower clamp bar to move between the first and second positions.

In some embodiments, the retainer block includes screw apertures for receiving screws that secure the retainer block to the instrument headstock.

BRIEF DESCRIPTION OF THE DRAWINGS

Other embodiments of the invention will become apparent by reference to the detailed description in conjunction with the figures, wherein elements are not to scale so as to more clearly show the details, wherein like reference numbers indicate like elements throughout the several views, and wherein.

DETAILED DESCRIPTION

Figure 1:
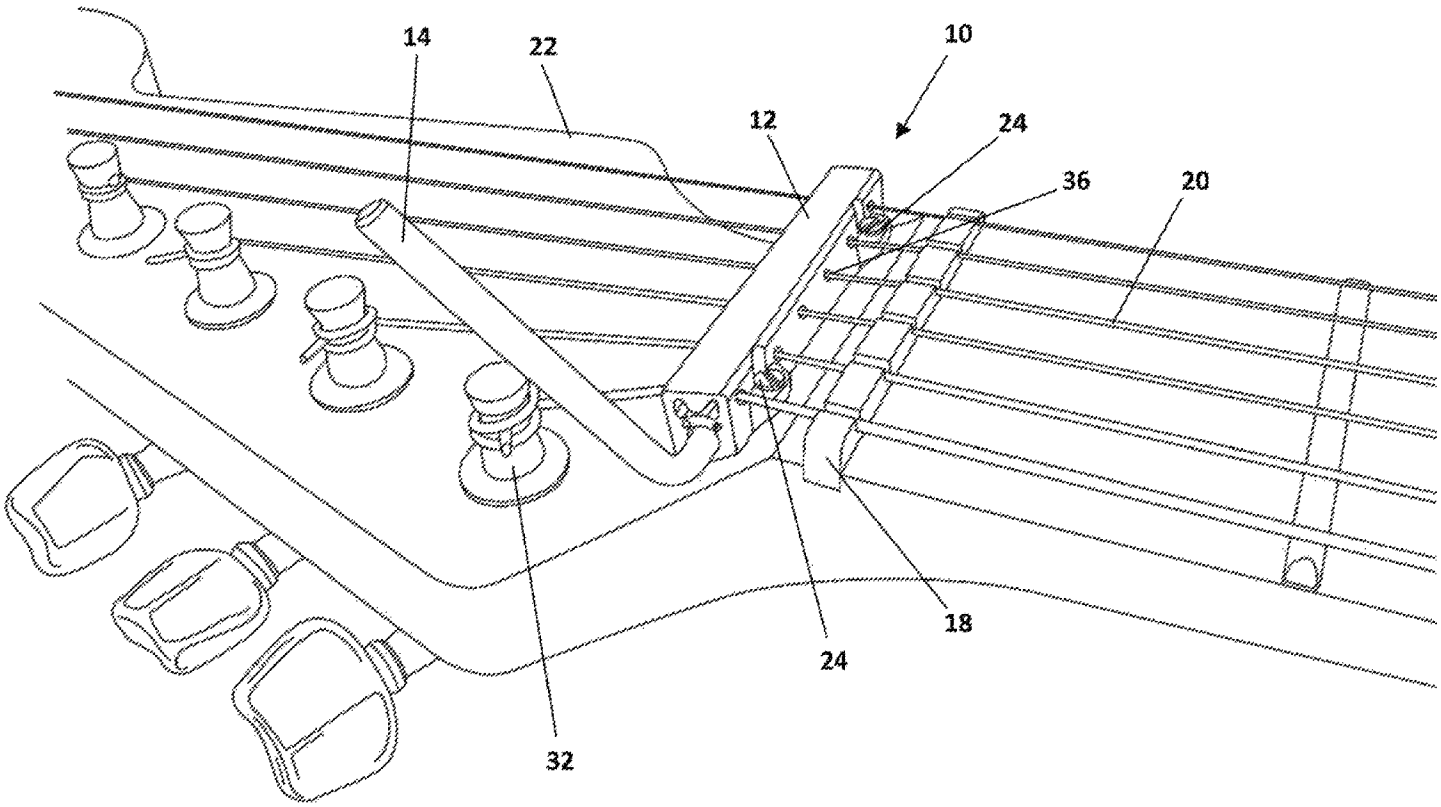
FIG. 1 depicts a locking string retainer installed on a guitar headstock according to a preferred embodiment.

Described herein is a locking string retainer that may be used to achieve near zero travel of instrument strings across the nut of a stringed musical instrument, such as a guitar. As shown in FIG. 1, a preferred embodiment of the string retainer 10 attaches to the instrument headstock 22 just behind the nut 18. The retainer 10 sets the angle at which the strings 20 contact the nut, and includes a locking mechanism operated by a lever 14. The instrument can be used and tuned normally when the locking mechanism is inactive. When the locking feature is desired, the user can operate the locking lever 14 and the retainer 10 will allow near zero travel of the string 20 across the nut 18, even during aggressive use of a vibrato bar. When the instrument inevitably does go out of tune, the user can easily unlock the retainer 10, retune, and re-lock the retainer.

Figure 2A:
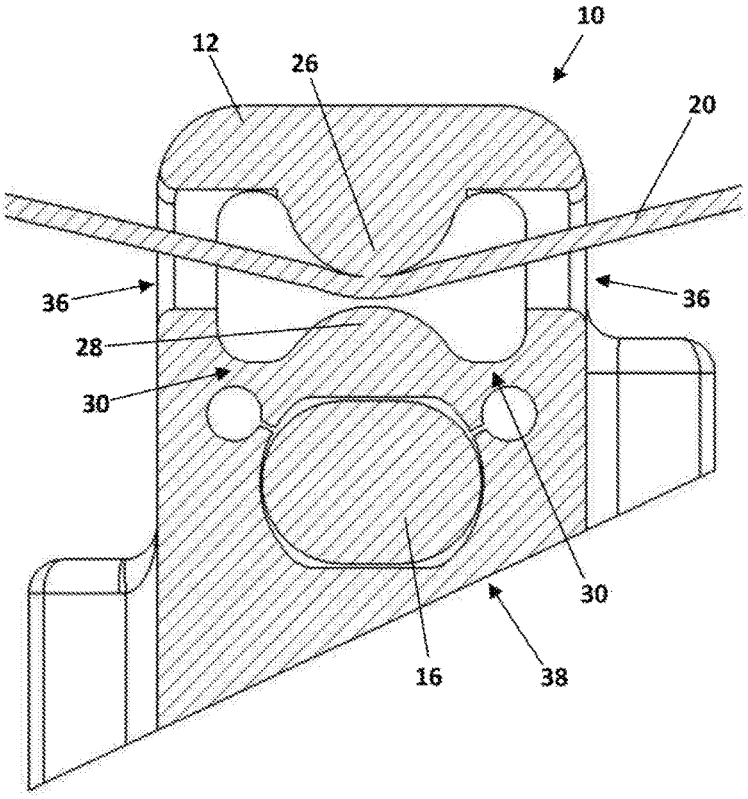
FIG. 2A depicts a section view of a retainer block and cam rod of the locking string retainer in an unlocked position according to a preferred embodiment.
Figure 2B:
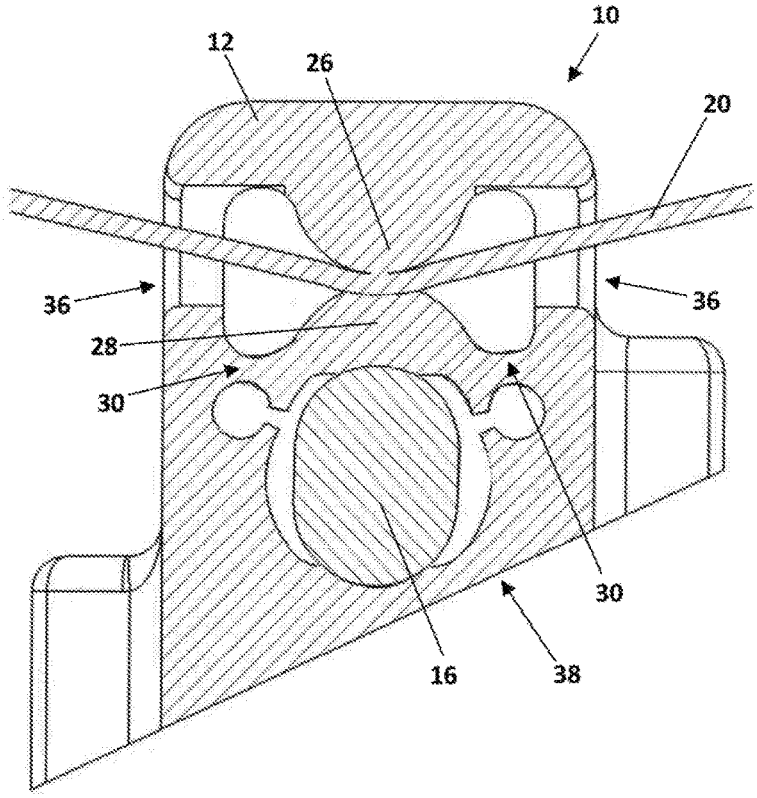
FIG. 2B depicts a section view of a retainer block and cam rod of the locking string retainer in a locked position according to a preferred embodiment.

As shown in FIGS. 2A and 2B, the string retainer 10 includes a retainer block 12 having an upper clamp bar 26, a lower clamp bar 28, apertures 36 for receiving the strings 20, and an engagement surface 38 that makes contact with the instrument headstock 22. The retainer block 12 is preferably formed by 3D printing from acrylonitrile butadiene styrene (ABS) or other similar thermoplastic. The geometry of the string retainer 10 is configured so that the strings 20 must make contact with a convex lower surface of the upper clamp bar 26 as they pass through the retainer 10. The lower clamp bar 28, which has a convex upper surface, is disposed below the strings 20 and upper clamp bar 26.

An actuator aperture 34, also referred to herein as a cam rod aperture, is disposed in the retainer block 12 directly below the lower clamp bar 28. A clamping actuator 16 is disposed within the actuator aperture 34 and is operable to move the lower clamp bar 28 upward into contact with the strings 20. As shown in FIGS. 2A and 2B, as the clamping actuator 16 is engaged, an upward force is applied to the bottom surface of the lower clamp bar 28 which causes it to be displaced upwardly due to the flexibility of flexure portions 30 provided on either side of the lower clamp bar 28. In the preferred embodiment, the clamping actuator 16 is a cam rod that is rigidly affixed to the lever 14 or formed integrally with the lever 14.

When the clamping actuator 16 is engaged, the contact between the lower clamp bar 28 and the strings 20 is restricted to the region of contact between the lower surface of the upper clamp bar 26 and the strings 20. This fact and the rigidity of the upper clamp bar 26 together ensure that there is near zero movement of the strings 20 when the clamping force is applied. In this manner, the application of the clamping force will not knock the strings 20 out of tune.

Once clamped, the motion of the strings 20 across the nut—either by pitch changes induced by a vibrato bar or by tension changes due to normal playing—are greatly reduced. The free length of the strings 20 from the nut 18 to the retainer 10 is intentionally much shorter than the free length from the nut 18 to the tuners 32. Because displacement of the string 20 across the nut 18 is proportional to the free length of the string 20 behind the nut 18, the opportunity for tuning errors due to motion of the string 20 across the nut 18 is greatly reduced.

Figure 3:
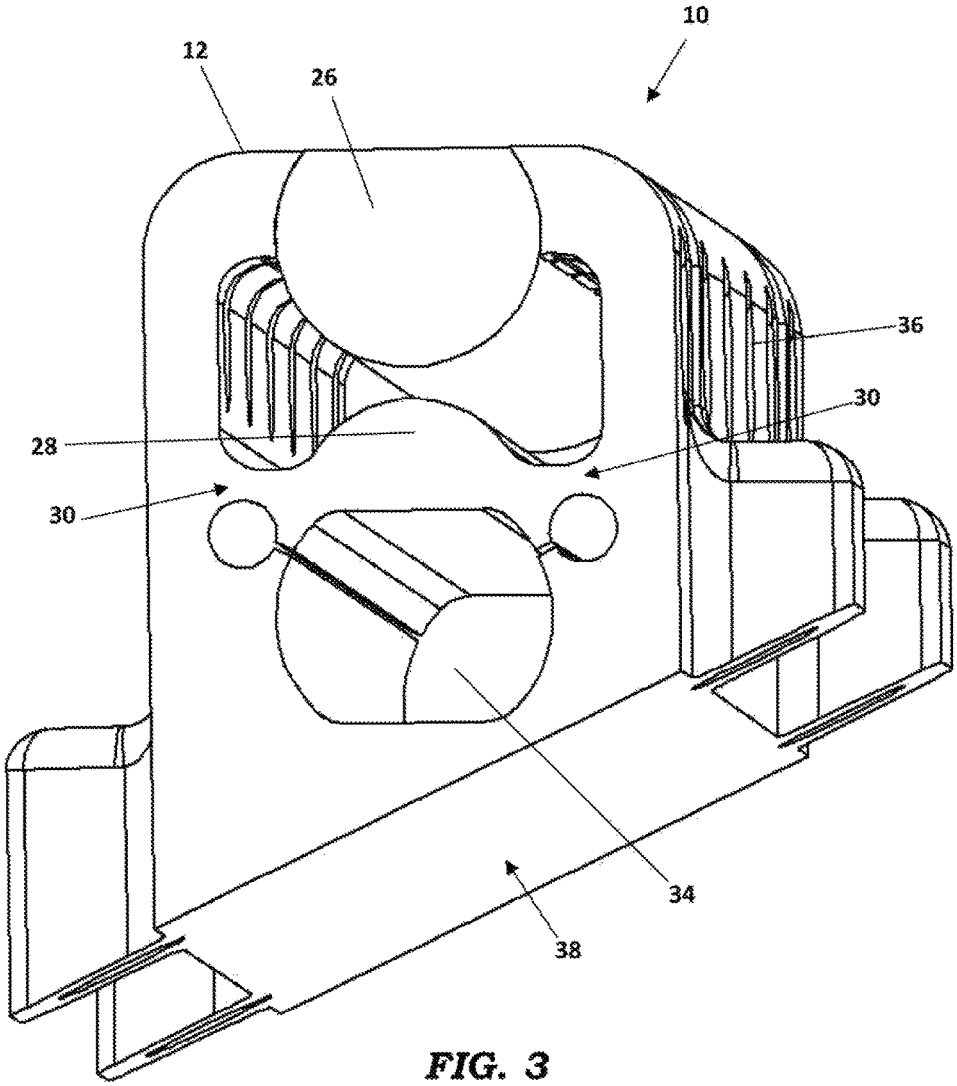
FIG. 3 depicts a bottom perspective view of a retainer block of the locking string retainer according to an alternative embodiment.

FIG. 3 depicts an alternative embodiment in which the upper clamp bar 26 is formed from a different material than the retainer block 12. For example, the upper clamp bar 26 of this embodiment may be formed of brass or another metal, or it may be formed from another rigid plastic.

As used herein, the terms upper and lower, and top and bottom are intended to provide understanding with regard to the figures and are not intended to limit the possible orientations of the disclosed structures. The structures described herein may be disposed in a variety of desired orientations when attached to a musical instrument—including various angles, sideways, and upside-down.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A string retainer for securing musical instrument strings in relation to an instrument headstock, the string retainer comprising:

a retainer block configured to be secured to the instrument headstock between a nut and a tuner of a stringed musical instrument, the retainer block comprising:

an engagement surface that engages the instrument headstock when the retainer block is secured to the instrument headstock;

a plurality of string apertures spaced apart from the engagement surface, the string apertures for receiving the instrument strings;

an upper clamp bar disposed adjacent the string apertures and spaced apart from the engagement surface, the upper clamp bar having a lower surface against which the instrument strings make contact; and a lower clamp bar disposed adjacent the string apertures and between the upper clamp bar and the engagement surface, the lower clamp bar having an upper surface that is operable to move from a first position in which the upper surface makes contact with the instrument strings and a second position in which the upper surface is spaced apart from the instrument strings; and a clamping actuator that engages the lower clamp bar to cause the upper surface of the lower clamp bar to selectively move between the first and second positions, wherein, when the upper surface of the lower clamp bar is in the first position, the upper surface presses the strings firmly against the lower surface of the upper clamp bar, thereby substantially immobilizing the strings in relation to the upper clamp bar, and wherein, when the upper surface of the lower clamp bar is in the second position, the strings are free to move in relation to the lower surface of the upper clamp bar.

2. The string retainer of claim 1 wherein the clamping actuator comprises:

an actuator aperture disposed in the retainer block between the lower clamp bar and the engagement surface;

a cam rod rotatably disposed within the actuator aperture; and a lever affixed to an end of the cam rod, wherein force applied to the lever causes the cam rod to rotate within the actuator aperture into a first rotational position in which the cam rod engages the lower clamp bar to urge the upper surface of the lower clamp bar to move into the first position, and wherein force applied to the lever causes the cam rod to rotate within the actuator aperture into a second rotational position in which the cam rod is disengaged from the lower clamp bar to allow the upper surface of the lower clamp bar to move into the second position.

3. The string retainer of claim 2 wherein the cam rod and the lever are integrally formed from one piece of metal.

4. The string retainer of claim 1 wherein the upper clamp bar, lower clamp bar, string apertures, and engagement surface are integrally formed from one piece of material.

5. The string retainer of claim 4 wherein the material is plastic.

6. The string retainer of claim 1 wherein the upper clamp bar is formed from metal, and the lower clamp bar, string apertures, and engagement surface are integrally formed from one piece of plastic.

7. The string retainer of claim 1 wherein the retainer block further comprises flexure portions disposed to either side of the lower clamp bar that provide sufficient flexibility to allow the lower clamp bar to move between the first and second positions.

8. The string retainer of claim 1 wherein the retainer block further comprises a plurality of screw apertures for receiving screws that secure the retainer block to the instrument headstock.

9. A string retainer for securing musical instrument strings in relation to an instrument headstock, the string retainer comprising:

a retainer block configured to be secured to the instrument headstock between a nut and a tuner of a stringed musical instrument, the retainer block comprising:

an engagement surface that engages the instrument headstock when the retainer block is secured to the instrument headstock;

a plurality of string apertures spaced apart from the engagement surface, the string apertures for receiving the instrument strings;

an upper clamp bar disposed adjacent the string apertures and spaced apart from the engagement surface, the upper clamp bar having a lower surface against which the instrument strings make contact;

a lower clamp bar disposed adjacent the string apertures and between the upper clamp bar and the engagement surface, the lower clamp bar having an upper surface that is operable to move from a first position in which the upper surface makes contact with the instrument strings and a second position in which the upper surface is spaced apart from the instrument strings, wherein, when the upper surface of the lower clamp bar is in the first position, the upper surface presses the strings firmly against the lower surface of the upper clamp bar, thereby substantially immobilizing the strings in relation to the upper clamp bar, and wherein, when the upper surface of the lower clamp bar is in the second position, the strings are free to move in relation to the lower surface of the upper clamp bar;

a cam rod aperture disposed between the lower clamp bar and the engagement surface; and flexure portions disposed to either side of the lower clamp bar to provide sufficient flexibility to allow the lower clamp bar to move between the first and second positions;

a cam rod rotatably disposed within the cam rod aperture; and a lever affixed to an end of the cam rod, wherein force applied to the lever causes the cam rod to rotate within the cam rod aperture into a first rotational position in which the cam rod engages the lower clamp bar to urge the upper surface of the lower clamp bar to move into the first position, and wherein force applied to the lever causes the cam rod to rotate within the cam rod aperture into a second rotational position in which the cam rod is disengaged from the lower clamp bar to allow the upper surface of the lower clamp bar to move into the second position.

10. The string retainer of claim 9 wherein the cam rod and the lever are integrally formed from one piece of metal.

11. The string retainer of claim 9 wherein the upper clamp bar, lower clamp bar, string apertures, and engagement surface are integrally formed from one piece of material.

12. The string retainer of claim 11 wherein the material is plastic.

13. The string retainer of claim 9 wherein the upper clamp bar is formed from metal, and the lower clamp bar, string apertures, and engagement surface are integrally formed from one piece of plastic.

14. The string retainer of claim 9 wherein the retainer block further comprises a plurality of screw apertures for receiving screws that secure the retainer block to the instrument headstock.

15. The string retainer of claim 9 wherein placement of the string apertures in the retainer block ensures that there is a region of contact between the instrument strings and the bottom surface of the upper clamp bar.

16. The string retainer of claim 15 wherein movement of the lower clamp bar into the first position creates contact between the instrument strings and the upper surface of the lower clamp bar that is restricted to the region of contact between the instrument strings and the bottom surface of the upper clamp bar.

* * * * *